US006199479B1

(12) United States Patent
Isozaki et al.

(10) Patent No.: US 6,199,479 B1
(45) Date of Patent: Mar. 13, 2001

(54) METHOD AND APPARATUS FOR STENCIL PRINTING

(75) Inventors: Takashi Isozaki; Hiroyasu Kato; Kenji Suzuki; Sadanao Okuda, all of Inashiki-gun (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/418,592

(22) Filed: Oct. 15, 1999

(30) Foreign Application Priority Data

Oct. 15, 1998 (JP) ..... 10-293752

(51) Int. Cl.[7] ..... B05D 1/32; B41L 13/06
(52) U.S. Cl. ..... 101/129; 101/120; 101/116
(58) Field of Search ..... 101/114, 116, 101/119, 120, 127.1, 129, 128.21, 128.4

(56) References Cited

U.S. PATENT DOCUMENTS

| | | | | |
|---|---|---|---|---|
| 3,971,313 | | 7/1976 | Voegelin | 101/127.1 |
| 4,003,877 | * | 1/1977 | Lipson et al. | 260/49 |
| 4,107,003 | | 8/1978 | Anselrode | 204/16 |
| 4,379,185 | * | 4/1983 | Smith et al. | 101/129 |
| 4,497,249 | | 2/1985 | Mitter | 101/120 |
| 5,662,040 | * | 9/1997 | Mori et al. | 101/116 |
| 5,786,029 | * | 7/1998 | Watanabe | 101/129 |

FOREIGN PATENT DOCUMENTS

| | | |
|---|---|---|
| 0 653 312 A2 | 5/1995 | (EP) . |
| 0 696 513 A1 | 1/1996 | (EP) . |

* cited by examiner

*Primary Examiner*—John S. Hilten
*Assistant Examiner*—Leslie J. Grohusky
(74) *Attorney, Agent, or Firm*—Pillsbury Winthrop LLP

(57) ABSTRACT

By preventing a deformation of printing drum of a rotary stencil printing apparatus caused at the time of printing, uniform printed images can be printed even under conditions such as low temperature and high-speed printing and even using an apparatus provided with a large-sized drum. That is, the invention provides a method for stencil printing which comprises winding a perforated stencil sheet around the peripheral wall of a cylindrical printing drum having an ink permeable peripheral wall and rotating around its central axis, supplying an ink to the peripheral wall from the inside of the drum at the time of rotation of the drum, and pressing a printing paper to the outer surface of the peripheral wall of the drum to transfer the ink to the printing paper through the stencil sheet, wherein the peripheral wall of the drum has such a strength that the peripheral wall shows a stress of 0.75 kgf/cm$^2$ or more, preferably 1.4 kgf/cm$^2$ or more when it is deformed by 0.1 cm in a direction towards its central axis and viscosity of the ink is 330 Pa•s or lower, preferably 150 Pa•s or lower. An apparatus for carrying out the stencil printing is also provided.

14 Claims, 2 Drawing Sheets

METHOD AND APPARATUS FOR STENCIL PRINTING

FIELD OF THE INVENTION

The present invention relates to a method and an apparatus for stencil printing according to which images can be uniformly printed by preventing deformation of printing drum at printing.

BACKGROUND OF THE INVENTION

As shown in FIG. 1, a rotary stencil printing apparatus is provided with a cylindrical printing drum 1 which rotates around its central axis, and the drum 1 has an ink passing peripheral wall composed of a material having many pores or a mesh material. This drum 1 can generally be made by a method of rolling a plate material such as a punching metal and an expanded metal into a cylindrical form and holding both ends by flanges, a method of fixing a part of a mesh material such as a screen to a flange to hold it in a cylindrical form, or a method of fitting flanges at both ends of a cylindrical shaped article, and the basic strength of the peripheral wall of the drum is determined by the materials constituting the drum. If necessary, one or more screen layers of micro-reticulate structure (not shown) can be wound around the peripheral surface of the drum 1.

Inside the drum 1, is provided an ink supplying means comprising a squeegee roller 4 which contacts with the inner peripheral surface of the drum, a doctor roller 5 which is disposed adjacent the squeegee roller, and others. Outside the drum 1, is disposed an opposing roller 6 at the position opposite to the squeegee roller 4, and the opposing roller 6 functions as a means of carrying a printing paper 10 in cooperation with the drum 1 with nipping the printing paper therebetween at the time of printing. According to FIG. 1, the opposing roller 6 is provided so that it can contact with and leave from the drum 1, and has a function to press the printing paper 10 against the outer peripheral surface of the drum 1 at the time of printing. Alternatively, the opposing roller 6 may have a diameter similar to that of the drum 1, and the squeegee roller 4 may have a function to press the peripheral wall of the drum 1 outwardly to deform the peripheral wall in such a manner that the peripheral wall can contact with and leave from the opposing roller 6, and the printing paper 10 may be carried with being nipped between the deformed drum and the opposing roller 6.

At the time of printing, one end of perforated stencil sheet 8 is clamped by a clamping means 2 provided at the outer peripheral surface of the drum 1 and the stencil sheet 8 is wound around the outer peripheral surface of the drum 1. When the drum is rotated, ink is supplied to the peripheral surface from inside of the drum 1 by the squeegee roller 4 and excess ink forms a reservoir of ink 7 between the squeegee roller 4 and the doctor roller 5. In this case, the printing paper 10 is carried with being nipped between the opposing roller 6 and the outer peripheral surface of the drum 1, whereby the ink is transferred to the printing paper through the stencil sheet 8 to perform printing. Under usual printing conditions, the drum 1 undergoes some deformation by pressing force at the nip portion at which the opposing roller 6 and the drum 1 contact with each other, but the apparatus must be designed so that other portions of the drum 1 are not deformed at the time of rotating in order to prevent slippage of the stencil sheet or creasing of the printing paper at the time of carrying the paper.

Although the peripheral wall of the drum can keep cylindrical shape under usual printing conditions, it sometimes undergoes deformation under some using conditions such as low temperature and high-speed printing. The similar phenomenon is also seen in an apparatus provided with a large drum designed so as to apply to the use of large-sized printing papers. As shown in FIG. 2, this deformation appears as a phenomenon that at the time of rotation of the drum 1 the periphery wall of the drum 1 deforms in the direction towards the squeegee roller 4 at the position 9 which is slightly downstream in rotation direction from the contact portion of the squeegee roller 4 and the drum 1, and this causes unevenness in the resulting printed images.

SUMMARY OF THE INVENTION

The object of the present invention is to elucidate the causes for the deformation of the drum as mentioned above, and to prevent the deformation so that uniform printed images can be obtained even under the using conditions such as low temperature and high-speed printing and even by the apparatuses provided with a large-sized drum.

As a result of intensive research conducted by the inventors on the strength of drum and the viscosity of ink, they have considered that the deformation at the position 9 of the drum shown in FIG. 2 is caused by the viscosity of ink collected between the portion 9 and the squeegee roller 4, and have found that the deformation of the drum can be prevented when the peripheral wall of the drum has a strength higher than a certain value and viscosity of the ink supplied to the drum is lower than a certain value. Thus, the present invention has been accomplished.

That is, according to the present invention, there is provided a method for stencil printing which comprises providing a cylindrical printing drum which has an ink permeable peripheral wall and rotates around a central axis thereof, winding a perforated stencil sheet around the peripheral wall of said printing drum, supplying an ink to the peripheral wall from the inside of the drum at the time of rotation of the drum, and transferring the ink to a printing paper through the drum and the stencil sheet, wherein said peripheral wall of the drum has such a strength that the peripheral wall shows a stress of 0.75 kgf/cm$^2$ or more when it is deformed by 0.1 cm in a direction towards the central axis and viscosity of said ink is 330 Pa•s or lower.

Furthermore, according to another aspect of the present invention, there is provided an apparatus for stencil printing comprising a cylindrical printing drum which has an ink permeable peripheral wall and rotates around a central axis thereof with a perforated stencil sheet being wound around the peripheral wall, an ink which is introduced into the inside of the drum, an ink supplying means which contacts with an inner surface of the peripheral wall of the drum and supplies an ink to the peripheral wall at the time of rotation of the drum, and an opposing roller which is disposed opposite to the ink supplying means and carries a printing paper with nipping the printing paper between the opposing roller and the peripheral wall of the drum, wherein said peripheral wall of the drum has such a strength that the peripheral wall shows a stress of 0.75 kgf/cm$^2$ or more when it is deformed by 0.1 cm in a direction towards the central axis and viscosity of said ink is 330 Pa•s or lower.

According to the present invention, strength of the drum is specified by the stress generated when the peripheral wall of the drum is deformed, and printing is carried out using a drum which shows a stress of 0.75 kgf/cm$^2$ or more, preferably 1.4 kgf/cm$^2$ or more when the peripheral wall is deformed by 0.1 cm in the direction towards its central axis, and using an ink having a viscosity of 330 Pa•s or lower, preferably 150 Pa•s or lower, whereby deformation of the drum can be prevented because the strength of the peripheral wall of the drum at the position indicated by 9 in FIG. 2 exceeds a deformation force exerted to the drum by the viscosity of the ink.

In the case of a drum formed of usual materials, when the stress is increased to more than 9.00 kgf/cm$^2$, thickness of the drum must be increased or opening ratio must be lowered and this causes blurring of printed images or decrease of printing density. Moreover, the viscosity of the ink is preferably 9 Pa•s or more. If the viscosity is lower than 9 Pa•s, ink drips on the drum from the squeegee roller during waiting period or leaks from a gap between the drum and the stencil sheet, or printed images spread.

The drum of the present invention may be made of any materials as far as the above strength is satisfied, and thickness, opening pore pattern, opening ratio and processing method of the peripheral wall of the drum can be optionally set.

BRIEF DESCRIPTION OF THE FIGURES

The accompanying drawings will be explained below briefly.

DETAILED DESCRIPTION OF THE INVENTION

Hereinafter, the present invention will be explained in more detail by way of presently preferred working examples. However, it should be understood that the present invention is not limited to the examples.

EXAMPLE 1

Figure 1:
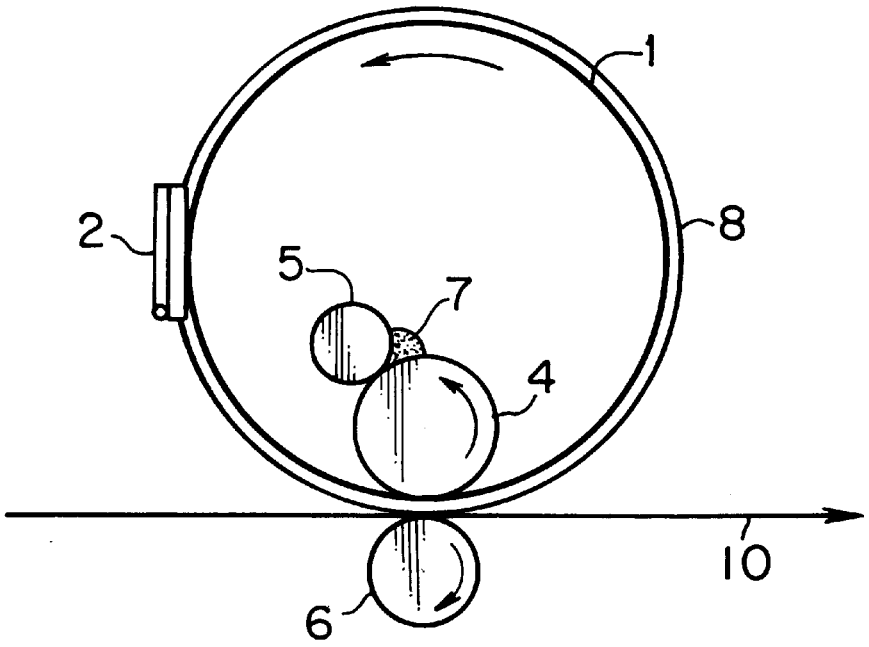
FIG. 1 is a schematic sectional view illustrating printing mechanism of a rotary stencil printing apparatus.
Figure 2:
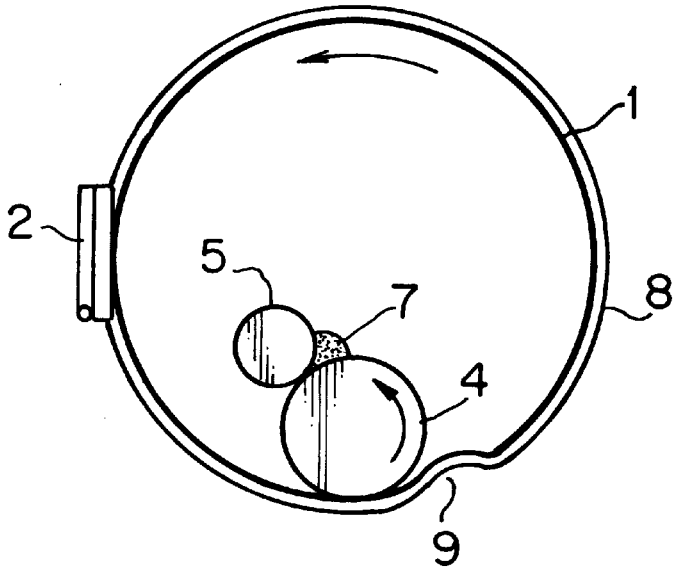
FIG. 2 is a schematic sectional view showing the defect in the conventional stencil printing method.

Printing was conducted by a stencil printing apparatus (RISOGRAPH GR377 manufactured by RISO KAGAKU CORPORATION) having a construction shown in FIG. 1 in which the printing drum had a peripheral wall made of a nickel electroformed material having a thickness of 0.2 mm, a pore diameter of 0.2 mm and an opening ratio of 12%, using inks of various viscosities shown in Table 1, at a printing environmental temperature of 23° C. with changing the printing speed from 60 to 130 rpm. The deformation of the drum was visually examined. The results are shown in Table 1.

Figure 3:
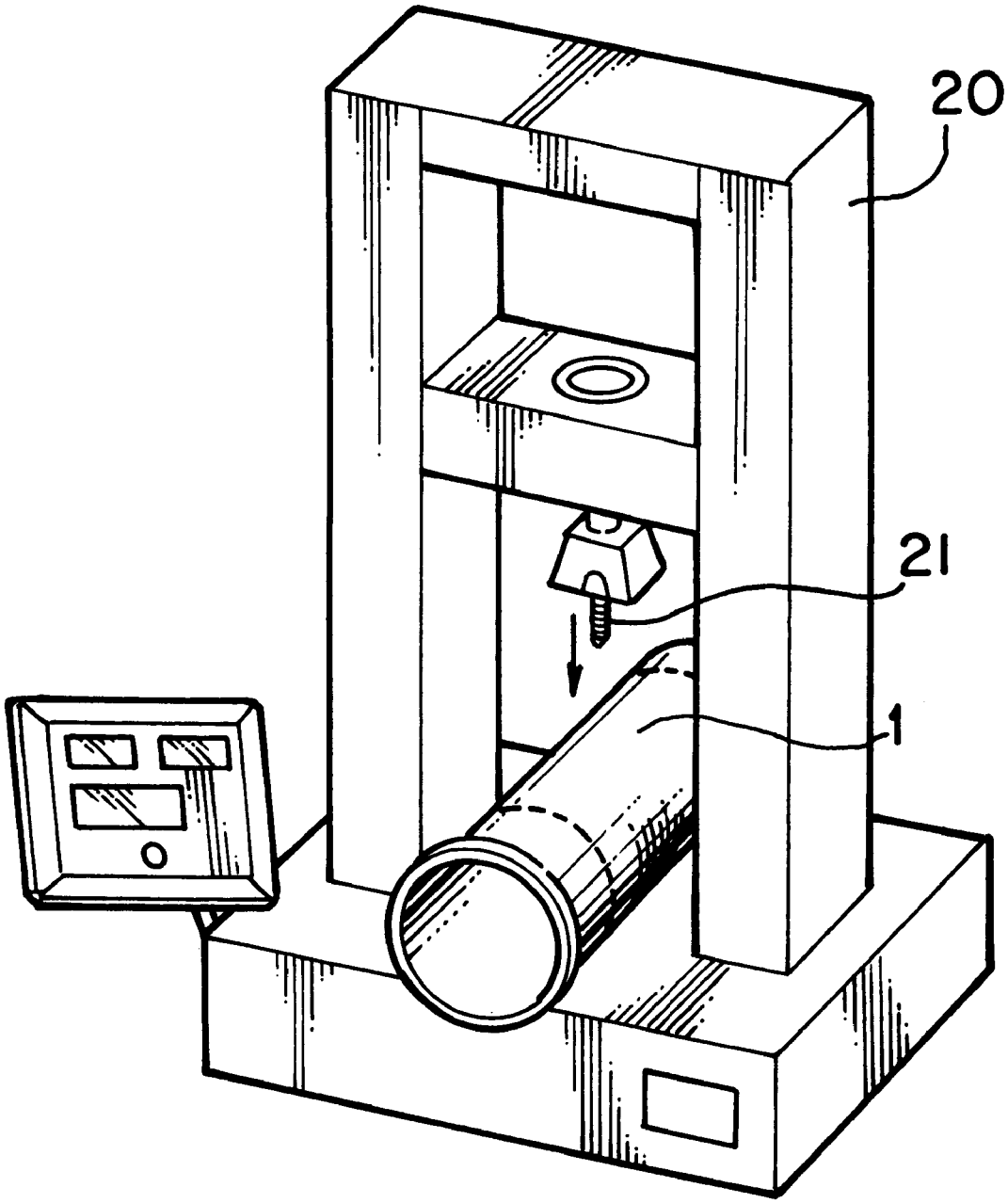
FIG. 3 is an oblique view explaining the method for measurement of strength of the drum in the present invention.

The viscosity of inks was measured using a Brookfield viscometer (VISCOMETER-BH manufactured by TOKI SANGYO CO,. LTD.) with a No.7 rotor under the conditions of 23° C. and 20 rpm in rotating speed. As shown in FIG. 3, strength of the drum was determined by measuring a stress caused when a jig 21 of 0.5 cm in diameter was pressed to nearly the center of the peripheral wall of a drum at a speed of 1.0 cm/min to result in deformation of 0.1 cm in the direction towards the central axis of the drum, using a testing apparatus 20, namely AUTOGRAPH (AGS-500D) manufactured by SHIMADZU SEISAKUSHO, LTD.

EXAMPLE 2

Evaluation was conducted in the same manner as in Example 1, except that the peripheral wall of the drum was made of a nickel electroformed material having a thickness of 0.18 mm, a pore diameter of 0.2 mm and an opening ratio of 12%. The results are shown in Table 1.

EXAMPLE 3

Evaluation was conducted in the same manner as in Example 1, except that the peripheral wall of the drum was made of a stainless steel etched material having a thickness of 0.2 mm, a pore diameter of 0.2 mm and an opening ratio of 30%. The results are shown in Table 1.

EXAMPLE 4

Evaluation was conducted in the same manner as in Example 1, except that the peripheral wall of the drum was made of a nickel electroformed material having a thickness of 0.15 mm, a pore diameter of 0.2 mm and an opening ratio of 12%. The results are shown in Table 1.

EXAMPLE 5

Evaluation was conducted in the same manner as in Example 1, except that the peripheral wall of the drum was made of a stainless steel etched material having a thickness of 0.15 mm, a pore diameter of 0.2 mm and an opening ratio of 30%. The results are shown in Table 1.

COMPARATIVE EXAMPLE 1

Evaluation was conducted in the same manner as in Example 1, except that the peripheral wall of the drum was made of a nickel electroformed material having a thickness of 0.3 mm, a pore diameter of 0.3 mm and an opening ratio of 5%. The results are shown in Table 1.

COMPARATIVE EXAMPLE 2

Evaluation was conducted in the same manner as in Example 1, except that the peripheral wall of the drum was made of a stainless steel etched material having a thickness of 0.12 mm, a pore diameter of 0.2 mm and an opening ratio of 30%. The results are shown in Table 1.

TABLE 1

| Number of Examples | Ex.1 | Ex.2 | Ex.3 | Ex.4 | Ex.5 | C.Ex.1 | C.Ex.2 |
|---|---|---|---|---|---|---|---|
| Stress (kgf/cm$^2$) | 1.48 | 2.75 | 3.77 | 4.08 | 8.15 | 9.10 | 0.74 |
| Viscosity (Pa · s) | | | | | | | |
| 8 | ○ | ○ | ○ | ○ | ○ | ○ | x |
| 14 | ○ | ○ | ○ | ○ | ○ | ○ | x |
| 80 | ○ | ○ | ○ | ○ | ○ | ○ | x |
| 146 | Δ | ○ | ○ | ○ | ○ | ○ | x |
| 340 | x | x | x | x | x | x | x |

Note:
○: Deformation of drum did not occur at all printing speeds.
Δ: Deformation of drum occurred at a printing speed of 120 rpm or more.
x: Deformation of drum occurred at all printing speeds.
"Ex." means Example, and "C.Ex." means Comparative Example.

According to the present invention, stencil printing is carried out using a printing drum having a stress of 0.75 kgf/cm$^2$ or more, preferably 1.4 kgf/cm$^2$ or more when the peripheral wall of the drum is deformed by 0.1 cm in a direction towards the central axis of the drum and using an ink having a viscosity of 330 Pa•s or less, preferably 150 Pa•s or less. As a result, the peripheral wall of the drum is prevented from being deformed in the vicinity of an ink supplying means due to the viscosity of the ink, and therefore uniform printed images free from unevenness can be obtained.

What is claimed is:

1. A method for stencil printing which comprises providing a cylindrical printing drum which has an ink permeable peripheral wall and rotates around a central axis thereof, winding a perforated stencil sheet around the peripheral wall of said printing drum, supplying an ink to the peripheral wall from the inside of the drum at the time of rotation of the drum, and transferring the ink to a printing paper through the drum and the stencil sheet, wherein said peripheral wall of the drum has such a strength that the peripheral wall shows a stress of 0.75 kgf/cm$^2$ or more when it is deformed by 0.1 cm in a direction towards the central axis and viscosity of said ink is 330 Pa•s or lower.

2. A method for stencil printing according to claim 1, in which said peripheral wall of the drum has such a strength that the peripheral wall shows a stress of 2.4 kgf/cm$^2$ or more when it is deformed by 0.1 cm in a direction towards the central axis.

3. A method for stencil printing according to claim 1, in which said viscosity of the ink is 150 Pa•s or lower.

4. A method for stencil printing according to claim 1, in which said viscosity of the ink is at least 9 Pa•s to 330 Pa•s.

5. A method for stencil printing according to claim 1, in which said peripheral wall of the drum has such a strength that the peripheral wall shows a stress of 1.4 kgf/cm$^2$ to 9.00 kgf/cm$^2$ when it is deformed by 0.1 cm in a direction towards the central axis.

6. A method for stencil printing according to claim 1, in which said viscosity of the ink is at least 9 Pa•s to 150 Pa•s.

7. A method for stencil printing which comprises providing a cylindrical printing drum which has an ink permeable peripheral wall and rotates around a central axis thereof, winding a perforated stencil sheet around the peripheral wall of said printing drum, supplying an ink to the peripheral wall from the inside of the drum at the time of rotation of the drum, and transferring the ink to a printing paper through the drum and the stencil sheet, wherein said peripheral wall of the drum has a strength such that the peripheral wall shows a stress of 0.75 kgf/cm$^2$ to 9.00 kgf/cm$^2$ when it is deformed by 0.1 CM in a direction towards the central axis, and the viscosity of said ink is at least 9 Pa•s to 330 Pa•s.

8. An apparatus for stencil printing comprising a cylindrical printing drum which has an ink permeable peripheral wall and rotates around a central axis thereof with a perforated stencil sheet being wound around the peripheral wall, an ink which is introduced into the inside of the drum, an ink supplying means which contacts with an inner surface of the peripheral wall of the drum and supplies an ink to the peripheral wall at the time of rotation of the drum, and an opposing roller which is disposed opposite to the ink supplying means and carries a printing paper with nipping the printing paper between the opposing roller and the peripheral wall of the drum, wherein said peripheral wall of the drum has such a strength that the peripheral wall shows a stress of 0.75 kgf/cm$^2$ or more when it is deformed by 0.1 cm in a direction towards the central axis and viscosity of said ink is 330 Pa•s or lower.

9. An apparatus for stencil printing according to claim 8, in which said peripheral wall of the drum has such a strength that the peripheral wall shows a stress of 1.4 kgf/cm$^2$ or more when it is deformed by 0.1 cm in a direction towards the central axis.

10. An apparatus for stencil printing according to claim 8, in which said peripheral wall of the drum has such a strength that the peripheral wall shows a stress of 0.75 kgf/cm$^2$ to 9.00 kgf/cm$^2$ when it is deformed by 0.1 cm in a direction towards the central axis.

11. An apparatus for stencil printing according to claim 8, in which said viscosity of the ink is 150 Pa•s or higher.

12. An apparatus for stencil printing according to claim 8, in which said viscosity of the ink is at least 9 Pa•s to 330 Pa•s.

13. An apparatus for stencil printing according to claim 8, in which said peripheral wall of the drum has such a strength that the peripheral wall shows a stress of 1.4 kgf/cm$^2$ to 9.00 kgf/cm$^2$ when it is deformed by 0.1 cm in a direction towards the central axis.

14. An apparatus for stencil printing according to claim 8, in which the viscosity of the ink is at least 9 Pa•s to 150 Pa•s.

* * * * *